United States Patent [19]

Aoyama

[11] Patent Number: 4,783,913

[45] Date of Patent: Nov. 15, 1988

[54] SPIKE FOR GOLF SHOE

[75] Inventor: Yahyo Aoyama, Tokyo, Japan

[73] Assignee: Miyata Metal Manufacturing Co., Ltd., Tokyo, Japan

[21] Appl. No.: 46,263

[22] Filed: Apr. 15, 1987

[51] Int. Cl.[4] ..... A43B 5/00; A43B 15/00

[52] U.S. Cl. ..... 36/134; 36/67 D

[58] Field of Search ..... 36/67 D, 67 B, 67 R, 36/134, 127, 61, 62

[56] References Cited

U.S. PATENT DOCUMENTS

| | | | |
|---|---|---|---|
| 2,689,417 | 9/1954 | Bernstein | 36/67 D |
| 3,343,285 | 9/1967 | Kowal | 36/67 D |
| 3,828,364 | 8/1974 | Aoyama | 36/67 B |
| 4,063,372 | 12/1977 | MacNeill | 36/127 |
| 4,193,216 | 3/1980 | Veda | 36/67 D |
| 4,240,215 | 12/1980 | Broussard | 36/127 |
| 4,330,950 | 5/1982 | Reddien | 36/127 |
| 4,360,490 | 11/1982 | Collins | 36/59 B |
| 4,587,748 | 5/1986 | Collins | 36/134 |
| 4,633,600 | 11/1987 | Dassler et al. | 36/67 D |

FOREIGN PATENT DOCUMENTS

| | | | |
|---|---|---|---|
| 2607402 | 8/1977 | Fed. Rep. of Germany | 36/67 D |
| 0015077 | 11/1983 | Japan | 36/134 |
| 1082517 | 9/1967 | United Kingdom | 36/67 R |

*Primary Examiner*—Steven N. Meyers

*Attorney, Agent, or Firm*—John J. Byrne

[57] ABSTRACT

A spike intended for a golf shoe comprises: a spike body provided with a rear-end flange in a rear-end surface of which a small center hole is provided; a dish-like metallic plate having a central opening and a dish-like concave portion which corresponds in configuration to the rear-end flange of the spike body; and a fixing plate provided with a metallic disk body, a center pin provided in a central portion of the metallic disk body at its front surface so as to be inserted into the small center hole of the spike body, and a threaded shaft provided in a central position of a rear surface of the metallic disk body. In such spike, the spike body is inserted into the central opening of the metallic plate and embedded therein, and receives at the small center hole thereof the center pin of the fixing plate so that the spike body and the metallic plate are assembled and integrally fixed to each other together with the fixing plate by spot-welding a peripheral portion of the fixing plate to the metallic plate.

2 Claims, 4 Drawing Sheets

SPIKE FOR GOLF SHOE

BACKGROUND OF THE INVENTION

1. Field of the Invention:

The present invention relates to a spike intended for a golf shoe.

2. Description of the Prior Art:

Golf shoes are employed not only in walking on a golf course but also in walking on any of a concrete floor, a metallic plate and a gravel road in the golf course. Consequently, spikes intended for the golf shoes must be considerably durable. Hitherto, various proposals of such spikes intended for the golf shoes have been made. For example, U.S. Pat. No. 3,828,364 discloses a spike intended for a golf shoe, which spike is durable and good in workability in production.

However, such conventional spike intended for the golf shoe is still not sufficient in both of durability in use and workability in production.

SUMMARY OF THE INVENTION

It is an object of the present invention to provide a spike intended for a golf shoe, which spike is durable and easy in production while excellent in workability in its stamping operation of a trade mark.

According to the present invention, there is provided: In a spike intended for a golf shoe, having: a spike body provided with a rear-end flange in a rear-end surface of which a small center hole is provided; a dish-like metallic plate having a central opening and a dish-like concave portion corresponding in configuration to said rear-end flange of said spike body; and a fixing plate provided with a metallic disk body, a center pin provided in a central portion of said metallic disk body at its front surface so as to be inserted into said small center hole of said spike body, a plurality of small projections provided in the vicinity of a periphery of said metallic disk body at equal intervals along said periphery in said front surface of said metallic disk body, a threaded shaft provided in a central position of a rear surface of said metallic disk body, and radially-arranged notches provided over the entire surfaces of said metallic disk body; the improvement wherein: said spike body is inserted into said central opening of said dishlike metallic plate and embedded therein, and receives at said small center hole provided in the rear-end surface of said rear-end flange thereof said center pin of said fixing plate, so that said spike body, said dish-like metallic plate and said fixing plate are assembled and integrally fixed to each other by spot-welding a peripheral portion of said fixing plate to said dish-like metallic plate at said small projections of said fixing plate; and at least a pair of through-holes passing through both of said dish-like metallic plate and said fixing plate are provided in said spike.

The spike body of the spike intended for the golf shoes may be made of sintered carbide or a rigid plastic, which is adequately selected to be suitably adapted for use.

The through-holes passing through both of the dish-like metallic plate and the fixing plate are preferably a pair of diametrically opposed ones.

BRIEF DESCRIPTION OF THE DRAWINGS

The drawings show an embodiment of a spike intended for a golf shoe according to the present invention, in which.

DESCRIPTION OF THE PREFERRED EMBODIMENT

Figure 1:
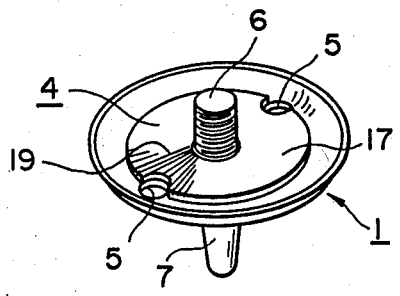
FIG. 1 is a perspective view of a completed spike intended for the golf shoe.
Figure 2:
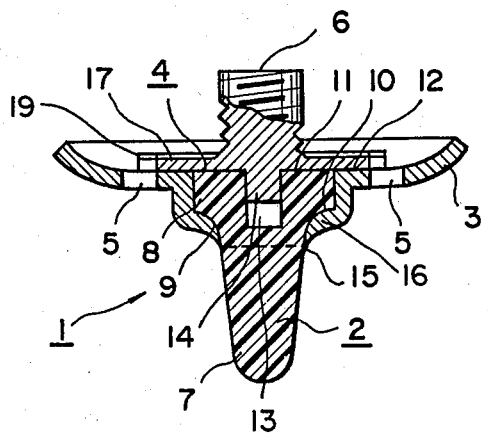
FIG. 2 is a longitudinal sectional view of the embodiment, taken along the line II—II of FIG. 1.

In the drawings: the reference numeral 1 denotes a spike intended for a golf shoe; 2 a spike body; 3 a dish-like metallic plate; 4 a fixing plate; 5 a through-hole into which a pin end of a face spanner fits; and 6 a threaded shaft provided in a central portion of the fixing plate 4.

In such embodiment shown in the drawings, the spike body 2 is made of a rigid plastic, while other components of the embodiment are made of stainless steels.

The spike body 2 has a frustoconical shape with a rounded tip portion 7 which may be shaped into any other conventional tip form adapted for a spike use.

The spike body 2 is provided with a rear-end flange 8 having a suitable thickness. Such rear-end flange 8 is adjacent to the thickest root portion 9 and cooperates therewith to prevent the spike body 2 from dropping out of the metallic plate 3, while such rear-end flange 8 reinforces the spike body 2 in assembling of the spike. Consequently, The spike body 2 is shaped at the rear-end flange 8 and the root portion 9 thereof to completely corresponding in configuration to an inner surface of a concave portion 10 of the metallic plate 3. In addition, the spike body 2 is also shaped into a form that enables the spike body 2 to keep its rear-end surface 11 at a level slightly higher than that of a surface 12 of the metallic plate 3. The rear-end surface 11 of the spike body 2 may be flush with the surface 12 of the metallic plate 3, and is prevented from being kept at a level lower than that of the surface 12. In case that the rear-end surface 11 of the spike body 2 is lower in level than the surface 12 of the metallic plate 3, it is necessary to increase a thickness of a central portion of the fixing plate 4, so as to compensate such lower level of the rear-end surface 11 of the spike body 2 by an increment of thickness of the central portion of the fixing plate 4.

A center pin 14 of the fixing plate 4 is neatly inserted into a small hole 13 of the spike body 2 so as not to provide any looseness therebetween.

An outer peripheral edge portion 16 of a central opening 15 of the metallic plate 3 is tapered so as not to provide any shoulder portion between the outer peripheral edge portion 16 and an outer periphery of the spike body 2 which is inserted into the central opening 15 of the metallic plate 3, whereby the spike provides a smooth outline between the metallic plate 3 and the spike body 2. This is a preferable construction of the metallic plate 3.

The fixing plate 4 is provided with: a metallic disk body 17; the center pin 14 provided in a central portion of the metallic disk body 17 at its front surface so as to be inserted into the small center hole 13 of the spike body 2; a plurality of small projections 18 provided in the vicinity of a periphery of the metallic disk body 17 at equal intervals along the periphery at the front surface of the metallic disk body 17; and radially-arranged notches 19 provided over the entire surfaces of the metallic disk body 17.

At least a pair of the through-holes 5, into which the pin ends of the face spanner fit, are diametrically provided in the metallic plate 3 and the fixing plate 4 so as to pass through both of them 3, 4. This is a preferable construction of the through-holes 5. It is also possible to provide four through-holes 5 at intervals of 90-degree about an axis of the spike body 2.

The metallic plate 3 may have a slight ovality.

FIGS. 3 to 7 are views for illustrating steps of a production process of the spike intended for the golf shoe according to the present invention.

Figure 3:
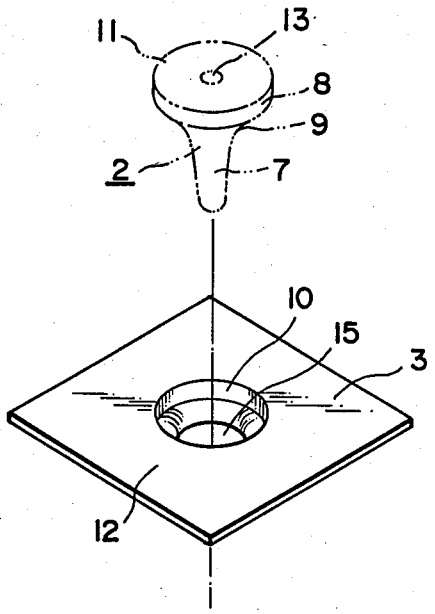
FIGS. 3 to 7 are views illustrating steps of assembling process of the embodiment of the spike of the present invention.
Figure 4:
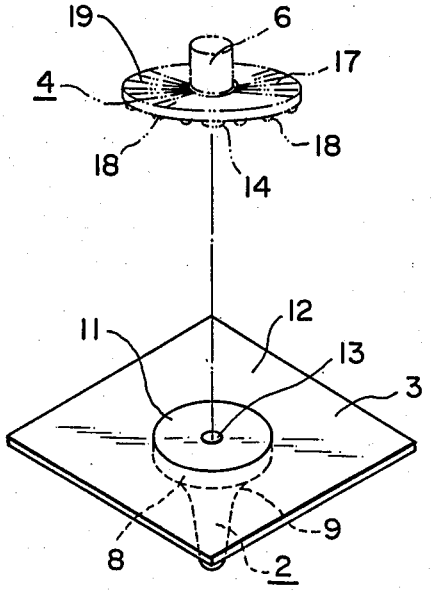
Figure 5:
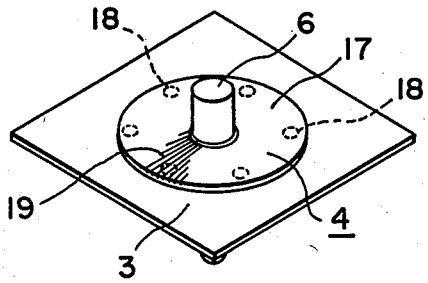
Figure 6:
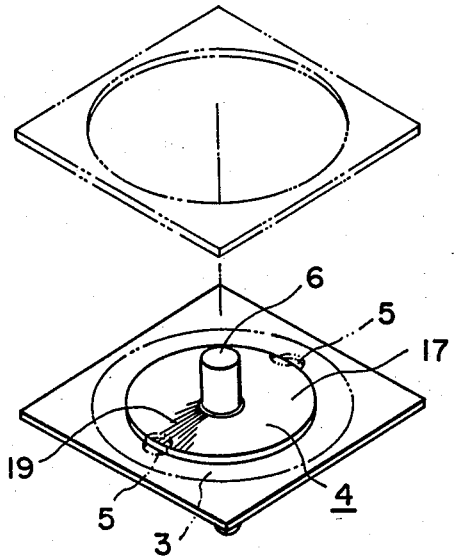
Figure 7:
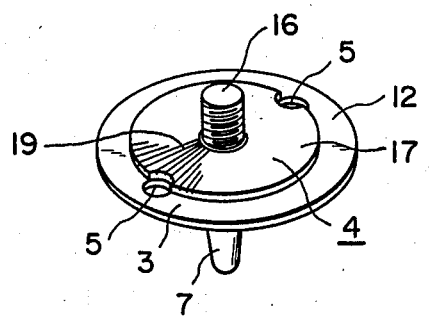

In production, as shown in FIG. 3, the spike body 2 is inserted into the central opening 15 provided in the dish-like concave portion 10 of the metallic plate 3, which concave portion 10 mates with the rearend flange 8 and the rood portion 9 of the metallic plate 3, so that the spike body 2 is embedded in the the concave portion 10 of the metallic plate 3 at its rear-end portion. After completion of such embedding, the rear-end surface 11 of the spike body 2 is substantially flush with or slightly higher in level than the surface 12 of the metallic plate 3. Then, as shown in FIG. 4, the center pin 14 of the fixing plate 4 is inserted into the small center hole 13 provided in the rear-end surface 11 of the spike body 2 so that the fixing plate 4 is mounted on both of the metallic plate 3 and the spike body 2. After that, the fixing plate 4 is spot-welded at its peripheral portion to the metallic plate 3 so that the three components, i.e., the spike body 2, metallic plate 3 and the fixing plate 4 are integrally assembled to each other in a very firm manner, whereby the fixing plate 4 is naturally prevented from being disengaged from the metallic plate 3 while the spike body 2 is fixed to them 3, 4 without any looseness. Then, as shown in FIGS. 6 and 7, the metallic plate 3 is subjected to a blanking operation for trimming off its edge portion, and then to a punching operation to form the through-holes 5 for receiving the pin ends of the face spanner. Thereafter, a screw cutting operation of the shaft 6 of the fixing plate 4 follows, and then a bulging operation of the peripheral portion of the metallic plate 3 is finally conducted to deflect such peripheral portion upward, so that the spike of the present invention intended for the golf shoe is completed.

Any of the components of the spike of the present invention may be made of any one of materials provided with suitable physical properties. Further, a stamping operation of a trade mark can be conducted as to each of the components of the spike before the assembling operation thereof is conducted, so that any problem as to the workability can be resolved. In addition, since the present invention has the above construction, it is possible to produce a spike having a sufficient strength in a very easy manner.

The spike of the present invention intended for the golf shoe can be installed in or removed from the golf shoe in a conventional manner, so that such manner is not described herein.

According to the present invention, it is also possible to divide any of the components of the spike of the present invention into a plurality of pieces having suitable shapes, which pieces differ from each other in physical properties such as strength and the like, to make it possible to assemple such pieces of the components to each other so as to produce a spike better in durability in use and workability in production than the spike having an integral construction.

What is claimed is:

1. A spike for sports shoes comprising:

a spike body;

a round dish-like metallic plate;

a fixing plate;

said spike body having a rear-end flange whose rear-end surface is formed with a small center hole;

said round dish-like metallic plate having a central opening for said spike body to be inserted, a dish-like concave portion of such configuration as adapted to receive said rear-end flange and a peripheral edge somewhat curved upward;

said fixing plate having a metallic disk body, a center pin protruding from a front surface of said dish body so as to be inserted in said small center hole, a threaded center shaft protruding from a rear surface of said dish body, and a plurality of small projections for the purpose of being subjected to spot-welding thereon and formed at equal intervals on the vicinity of and along a peripheral edge of said front surface of said disk body and a plurality of radially arranged notches formed on said rear surface; and at least a pair of through-holes passing through both of said dish-like metallic plate and said fixing plate.

2. A method of assembling a spike for sports shoes, which comprises:

embedding a spike body which includes a small center hole in the central opening of a dish-like metallic plate; mounting a fixing plate which includes a center pin on said dish-like metallic plate with the center pin inserted in said small center hole; spot-welding both said fixing plate and said dish-like metallic plate at a plurality of small projections disposed on said fixing plate so as to integrally assemble said fixing plate, said dish-like metallic plate and said spike body;

subjecting said metallic plate to a blanking operating for trimming off its edge portion to provide a round shape;

subjecting said metallic plate to a punching operation together with said fixing plate to provide for through holes for receiving the pin ends of a face spanner;

subjecting said center pin of said fixing plate to a screwcutting operation; and subjecting the peripheral edge of said metallic plate to a building operation to make it curved upward.

* * * * *